United States Patent [19]

Calabrese et al.

[11] Patent Number: 4,705,696

[45] Date of Patent: Nov. 10, 1987

[54] METHOD OF MAKING A LITHOGRAPHIC PRINTING PLATE, PRINTING PLATES MADE BY THE METHOD, AND THE USE OF SUCH PRINTING PLATES TO MAKE LITHOGRAPHIC PRINTS

[75] Inventors: Peter J. Calabrese, Montville; Galina Pismennaya, Palisades Park, both of N.J.

[73] Assignee: Olin Hunt Specialty Products Inc., Palisades Park, N.J.

[21] Appl. No.: 655,218

[22] Filed: Sep. 27, 1984

[51] Int. Cl.[4] ..... B41M 1/06; B41M 1/10

[52] U.S. Cl. ..... 427/14.1; 204/17; 101/459

[58] Field of Search ..... 430/49, 114, 31; 101/453, 454, 459, 463.1; 204/17; 427/14.1

[56] References Cited

U.S. PATENT DOCUMENTS

| | | | |
|---|---|---|---|
| Re. 25,444 | 9/1963 | Kuccra | 96/1 |
| Re. 27,613 | 4/1973 | Mignone | 101/132.5 |
| 2,297,691 | 10/1942 | Carlson | 95/5 |
| 2,647,464 | 8/1953 | Ebert | 101/426 |
| 2,681,310 | 6/1954 | Wood | 204/38 |
| 2,901,374 | 8/1959 | Gundlach | 117/17.5 |
| 2,912,586 | 11/1959 | Gundlach | 250/49.5 |
| 2,919,170 | 12/1959 | Epstein | 346/74 |
| 2,925,310 | 2/1960 | Perkins | 430/31 |
| 2,939,787 | 6/1960 | Giaimo, Jr. | 96/1 |
| 2,949,411 | 8/1960 | Beck | 204/56 |
| 2,952,536 | 9/1960 | Kurz | 96/1 |
| 2,957,765 | 10/1960 | Resetich | 96/1 |
| 2,958,599 | 11/1960 | Neugebauer | 96/33 |
| 2,983,221 | 5/1961 | Dalton et al. | 101/149.2 |
| 2,988,988 | 6/1961 | Kurz | 101/149.2 |
| 3,001,872 | 9/1961 | Kurz | 96/1 |
| 3,004,860 | 10/1961 | Gundlach | 117/17.5 |
| 3,063,859 | 11/1962 | Heckscher | 117/17.5 |
| 3,082,085 | 3/1963 | Miller et al. | 96/1 |
| 3,107,169 | 10/1963 | Bornarth | 96/1 |
| 3,121,009 | 2/1964 | Giaimo, Jr. | 96/1 |
| 3,148,057 | 9/1964 | Raether | 96/1 |
| 3,210,184 | 10/1965 | Uhlig | 96/1 |
| 3,234,904 | 2/1966 | Van Wagner | 118/638 |
| 3,256,811 | 6/1966 | Bach | 101/149.2 |
| 3,257,222 | 6/1966 | Carlson | 117/17.5 |
| 3,321,385 | 5/1967 | Fazzari | 204/42 |
| 3,393,070 | 7/1968 | Snelling | 96/1.5 |
| 3,409,429 | 11/1968 | Ekman et al. | 96/27 |
| 3,460,476 | 8/1969 | Swigert et al. | 101/450 |
| 3,594,289 | 7/1971 | Watkinson et al. | 204/38 A |
| 3,607,255 | 9/1971 | Back | 96/1 |
| 3,615,405 | 10/1971 | Shebanow | 96/1.5 |
| 3,650,797 | 3/1972 | Tomanek | 101/463.1 |
| 3,745,002 | 7/1973 | Honjo et al. | 101/459 |
| 3,753,760 | 8/1973 | Kosel | 117/37 LE |
| 3,807,304 | 4/1974 | Gracia et al. | 101/463 |
| 3,900,412 | 8/1975 | Kosel | 252/62.1 |
| 4,277,555 | 7/1981 | Fromson et al. | 430/278 |
| 4,427,500 | 1/1984 | Platzer | 101/463.1 |
| 4,457,992 | 7/1984 | Bhattacharjee et al. | 430/49 |

FOREIGN PATENT DOCUMENTS 201301 4/1955 Australia .

OTHER PUBLICATIONS

"Contact Angle Meters—Reflective Goniometers," Catalogue #15—Kernco Instruments Co., Inc.

S. Wernick and R. Pinner, *Surface Treatment of Aluminum,* Robert Draper Ltd. (1964), pp. 422–444; 510–580.

J. Th. A. Oberbeek, *Colloid and Surface Chemistry,* MIT (1970), Part I, pp. 11.6–11.8.

G. A. Stevenson, *Graphic Arts Encyclopedia,* McGraw-Hill (1968), pp. 216, 303–307.

Robert F. Leonard, *Economic and Technical Feasibility Study of a Laser Imaged Printing Plate,* Thesis—Worcester Polytechnic Institute May, 1981.

*Aluminum, vol. III, Fabrication and Finishing,* Kent R. Van Horn, Ed. American Society for Metals 1967, pp. 641–684.

John H. Powers, "Anodizing for the Graphic Arts Industry," TAGA Proceedings 1970, pp. 166–179.

*Primary Examiner*—John L. Goodrow

*Attorney, Agent, or Firm*—William A. Simons; Thomas P. O'Day

[57] ABSTRACT

An electrostatic charge is selectively applied to the anodized surface of an anodized aluminum plate in a predetermined pattern corresponding to the image to be printed, a liquid toner is applied to the charged portions of the anodized surface and the toner is fixed to the anodized surface to provide an imaged lithographic printing plate. The printing plate made by the method may be used to make lithographic prints by applying printing ink to the imaged portions of the plate and transferring the printing ink from the lithographic printing plate to a substrate.

20 Claims, No Drawings

METHOD OF MAKING A LITHOGRAPHIC PRINTING PLATE, PRINTING PLATES MADE BY THE METHOD, AND THE USE OF SUCH PRINTING PLATES TO MAKE LITHOGRAPHIC PRINTS

FIELD OF THE INVENTION

This invention relates to a novel method of imaging a lithographic printing plate in which a liquid toner is applied to and fixed to the anodized surface of an anodized aluminum plate, printing plates made by the method, and the use of such printing plates to make lithographic prints.

BACKGROUND OF THE INVENTION

Today, essentially all daily newspapers, and a substantial portion of other publications, are printed using lithographic printing plates. Such plates are sometimes referred to as "planographic" printing plates because both the printing and the non-printing areas of the plate lie in substantially the same plane. Thus, in place of the raised and lowered ink accepting surfaces found in letterpress and gravure printing plates, respectively, lithographic printing plates possess oleophilic ink receptive areas and hydrophilic non-ink receptive areas. The hydrophilic areas, which are readily wetted by water, tend to repel oil-based printing inks and correspond to the background non-printed areas of the image. The oleophilic areas, on the other hand, tend to attract oil-based inks and correspond to the printed areas of the image to be printed.

Lithographic printing plates of the type most commonly used by the daily newspaper industry typically comprise an aluminum substrate, an anodized aluminum layer on the surface of the substrate, and a photosensitive coating that is applied to the surface of the anodized aluminum layer opposite to the aluminum substrate.

The predominant method of imaging lithographic printing plates of the type described above involves exposing the photosensitive coating of the plate to light (e.g., actinic radiation) through a suitable photographic mask which bears a negative or positive of the image to be printed and which may include both continuous (text) and half-tone (picture) portions. The plate is then developed with a suitable developer to remove the photo-sensitive coating from the background areas of the image thereby uncovering the anodized surface of the plate in those areas. The developer may also act to enhance the oleophilic character of the photosensitive coating which remains in the areas of the plate which were exposed through the mask. Because this method requires the preparation of a photographic mask corresponding to the original work, and the lithographic plate is imaged from the mask rather than from the original work, it is considered to be an "indirect" imaging method.

More recently, direct imaging methods which do not require a photographic mask have been used commercially. In one such method, the photosensitive coating of a plate ike that described above is exposed to a computer controlled laser beam rather than to light through a photographic mask. The computer controls the laser based upon information electronically stored in digitized form. In another method, the photosensitive coating is made of a photoconductive material that is first electrostatically charged and then selectively discharged by exposure to a computer controlled laser beam. Toner is applied to the electrostatic image thus formed on the plate. After toning, the plate is developed to remove the photosensitive layer from the untoned areas thereby exposing the anodized aluminum layer of the plate in those areas.

Thus, a number of lithographic plate imaging techniques have been proposed in the art. Of those techniques, the ones that have been most successful commercially have been characterized by: (a) the use of a photosensitive layer which is selectively exposed to light; and (b) the removal of a portion of the photosensitive layer in a development step. Because the photosensitive materials used in such techniques typically are relatively expensive and the removal of portions of such layers during the preparation of imaged lithographic printing plates is a time-consuming expensive process, the development of simpler, less expensive techniques is highly desirable. Particularly desirable is the development of alternative commercially practicable techniques for making imaged lithographic printing plates that can be used to make more than 50,000 or even 100,000 or more prints of good quality.

SUMMARY OF THE INVENTION

The present invention is directed to a novel method of imaging a lithographic printing plate, to a novel printing plate produoed using that method and to a method of making lithographic prints using the novel printing plate. The present invention obviates the need to use photosensitive coatings with the printing plate and the need to use specialized developers which selectively remove the photosensitive coatings from the plates. The present invention also obviates the need to expose selectively the plates to a light source of any kind.

More particularly, the method of imaging a lithographic printing plate of the invention comprises the steps of:

(a) selectively applying an electrostatic charge to the anodized surface of an anodized aluminum plate in a predetermined pattern corresponding to the image to be printed;

(b) applying a liquid toner to the charged portions of the anodized surface; and (c) fixing the toner to the anodized surface to provide an imaged lithographic printing plate.

In a preferred embodiment of the method, an etching solution is applied to the imaged surface of the plate after the fixing step to increase the hydrophilicity of the plate's untoned surface area.

In another preferred embodiment, the electrostatic charge is applied to the surface of the plate using a point corona discharge, i.e., a stylus, to produce both full and half-tone electrostatic charge patterns. Preferably, a computer having information stored therein in digitized form is used to control the charging of the plate with a stylus. Alternatively, the electrostatic charge may be applied using a corona discharge and a silk screen mask.

The liquid toner that is applied to the charged portions of the anodized layer deposits an oleophilic film on those portions, but not on the uncharged portions, of that layer. Liquid toners that may be employed in the present method are relatively non-toxic as compared to the developers that are typically used to remove portions of the photosensitive layers in the prior art techniques for imaging lithographic printing plates described above.

The toner may be fixed to the surface of the plate by drying the plate at ambient or at elevated temperature. Printing ink may then be applied to the imaged portions of the printing plate and thereafter transferred from the printing plate to a substrate. The substrate may be paper, in which case a lithographic print is obtained directly, but preferably the substrate is a rubber roller of the type conventionally used in lithographic offset printing processes. In such offset processes, the ink is transferred first to the rubber roller and then to a substrate such as paper to obtain indirectly a lithographic print. In processes for making lithographic prints directly from the lithographic printing plate of the invention, the electrostatic charge pattern is applied to the anodized surface as a mirror image of the image to be printed whereas in the offset printing processes there is no need to apply such a wrong reading electrostatic charge pattern to the plate. Preferaby, at least about 50,000 impressions, and most preferably about 100,000 or more impressions, may be made from the imaged lithographic printing plate of the invention.

DETAILED DESCRIPTION OF THE INVENTION

In the method of the invention for imaging a lithographic printing plate, the first step is to apply an electrostatic charge, in a predetermined pattern, to the anodized surface of an anodized aluminum plate. Suitable anodized aluminum plates are readily available in the form of what are known as "wipe-on printing plates." Such plates are typically 0.01 inches thick, with the anodized aluminum layer being from 0.1 to 5 mils thick. Examples of commercially available anodized aluminum wipe-on printing plates that may be used in the present invention are the brush-grained aluminum plate sold by the Hydro-Graphics Corp., located in Irving, Tex., the chemically grained anodized aluminum plate sold by Ana-coil Corp., located in Rockville, Conn., the Advanced SR plate sold by Advanced Offset Company, located in Harold, Mass., and the Pitman SR plate sold by Harold M. Pitman Co. located in Secaucus, N.J.

The anodized surface of the pate preferably is grained to enhance adhesion to the plate surface during the toning and fixing steps. Graining is typically accomplished by roughening the surface of the aluminum plate prior to the anodizing step to provide a satin-like finish on the surface of the plate.

The effectiveness of a toner-imaged lithographic printing plate depends upon the relative difference in the hydrophilicity and oleophilicity between the toned and untoned areas of the plate's surface. The greater he relative difference, the more effective the plate in producing lithographic prints. The hydrophilicity and oleophilicity of the toned and untoned areas of the plate's surface may be determined by a person skilled in the art through measurement of the equilibrium contact angle for a drop of water or hydrocarbon, respectively, at the plate's surface. See, for example, *Hydrophobic Surfaces,* F. Fowkes, Ed. (Academic Press, New York 1960). We have found, for example, that a wettability difference of at east about 60° in the equilibrium contact angle of a 0.001 cc. drop of water on the toned areas of a plate as compared to the untoned areas of a plate generally provides a satisfactory print.

Corona discharge is the preferred means for applying the electostatic charge to the anodized surface of the aluminum plate. With such corona discharge, a relatively low, but stable, electrostatic charge may be established on the anodized surface of the plate. For example, a corona discharge may provide a 5–20 volt electrostatic charge on the plate's surface. The voltage that is used to produce the corona discharge may range from a few volts up to thousands of volts depending upon the particular apparatus used and the manner of applying the charge to the plate. The amount of charge that may be applied to the anodized surface depends to a large extent upon the thickness and porosity of the anodized aluminum layer. The greater the thickness and the lower the porosity of the layer, the greater the voltage level to which the surface of the anodized layer may be charged. If too great a charge is applied, a breakdown occurs which results in a loss of the charge from the anodized aluminum surface to the conductive aluminum substrate.

When a stylus is used to provide a point corona discharge, full and half-tone electrostatic images may be placed on the anodized surface of the plate. Such electrostatic images may be applied by a computer controlled stylus, whose distance from the surface of the anodized plate may be varied. By varying the distance between the point of the stylus and the surface of the plate, the surface area of the charge patterns applied by the stylus may be varied. For example, the greater the distance between the stylus and the plate's surface, the larger the surface area of the charge pattern placed on the surface. Accordingly, variously sized charge patterns may be applied to the plate with the stylus to produce electrostatic latent images on the plate's anodized surface.

Patterned electrostatic charges may also be applied to the surface of an anodized aluminum plate using an imaged silk screen mask and a corona discharge. The silk screen mask may be imaged by means well known in the silk screen art. The corona discharge may be produced using a corona wire at a relatively high voltage, for example, 5,000 to 10,000 volts. Imaging of the plate may be accomplished by placing the silk screen against the anodized surface of the aluminum plate and exposing the plate to the corona discharge through the silk screen for 5 to 10 seconds. The optimum voltage and exposure time that are used depend on such factors as the corona wire used, the distance between the corona wire and the anodized surface, and the thickness and porosity of the anodized aluminum layer.

After the eectrostatic latent image is formed on the anodized surface, a liquid toner is applied to that surface. The liquid toner that is used should be capable of depositing at the charged areas of the plate a material that is oleophilic and hydrophobic relative to anodized aluminum, and in an amount to provide, after fixing of the materia, an imaged lithographic plate capable of providing prints of satisfactory resolution and image density. Preferably, the liquid toner has a charge to mass ratio in the range of about $8\times10^{-3}$ to about $134\times10^{-3}$ coulombs per gram (C/g) and a conductivity in the range of about 13 to about 132 Nmhos/cm.

Preferred liquid toners for use in the invention comprise a non-aqueous dispersion. The dispersed phase preferably comprises a film forming polymer and a coloring materia, e.g., a dye or a pigment such as carbon black. The continuous phase preferably comprises a solvent-carrier and a charge director.

The solvent-carrier, which preferably constitutes 90 to 99% by weight of the liquid toner, may be a non-polar insulating liquid. Examples of suitable solvent-carriers are described in Kosel U.S. Pat. No. 3,900,412 (the '412 patent), the disclosure of which is incorporated herein by reference. Preferably, the solvent-carrier is nontoxic, and is characterized by low odor, a low K.B. (Kauri-butanol) number and a low aromatic content.

In addition, the solvent-carrier preferably has a low electrical conductivity and a low dielectric constant. Electrical conductivity preferably should be less than about $10^{-9}$ mho/cm, and the dielectric constant preferably should be less than three and one-half. The use of a solvent-carrier having these characteristics helps to insure that in use the liquid toner does not dissipate the pattern of electrostatic charges on the anodized surface of the plate.

Suitable film forming polymers are those which form a continuous fixed film on the anodized surface of the plate when the solvent-carrier is evaporated. Examples include polymers formed from one or more of the following monomers: vinylacetate, the $C_1$–$C_4$ alkyl esters of acrylic and methacrylic acids, styrene, methylstyrene, vinyltoluene and n-vinyl-pyrrolidone. Other exampes of film forming polymers are film forming amphipathic polymers. Suitable amphipathic polymers are described in Kosel U.S. Pat. No. 3,753,760 (the '760 patent), the disclosure of which is incorporated herein by reference. In particular, amphipathic polymers formed from the above-identified monomers are most preferred. Preferably, more than 50% by weight of the solids content of the liquid toner comprises film forming polymer and most preferably more than about 90% by weight of the solids content of the liquid toner comprises film forming polymer. As used herein, the "solids content" of the liquid toner includes all materials that remain upon evaporation of the liquid toner's solvent-carrier.

Preferably, the liquid toner includes one or more charge directors to increase the density of the toner image applied to a charged plate. Because of this increase in image density, the oleophilicity of the toned image areas is greater resulting in a better plate.

The use of charge directors in liquid toners is known in lhe art. For example, charge directors suitable for use in our liquid toner are described in the '760 patent at columns 19–20.

A coloring agent such as a dye, a pigment such as carbon black or a mixture of dyes and pigments is preferably also included in the liquid toner. Such a coloring agent is preferably included in the liquid toner so that toned images made by the toner are visible, thereby permitting inspection and evaluation of the toned image before applying ink to the plate. Various dyes and pigments that may be used in the iquid toner are disclosed in the previously cited Kosel '412 and '760 patents at columns 15–18.

The liquid toner should be contacted with the charged anodized aluminum surface for a time sufficient to obtain satisfactory toning of the electrostatic image on that surface. The appropriate contact time, which may range from a fraction of a second up to 5 minutes or more, will vary depending upon such factors as the specific toner being used and the level of charge applied to the plate. The optimum contact time for a given toner under various process conditions may be determined by a person skilled in the art.

Following the toning step, the plate may be rinsed with a non-polar, non-conducting solvent to remove excess liquid toner. Preferably, the solvent used for this purpose is the solvent-carrier used in the liquid toner.

The toner image is then fixed to the plate, preferably by drying. This may be accomplished at ambient temperature, or if a shorter drying time is desired, at an elevated temperature. Heat may be supplied for this purpose by infra-red lamps or by an oven. For example, plates may be dried by placing them in an oven for 1 to 10 minutes at a temperature between 100° and 200° C.

In a preferred embodiment of the invention, the hydrophilicity of the untoned areas of the plate may be increased by applying to the plate surface a phosphoric acid etch solution (e.g., by wiping the surface with the etch solution) comprising phosphoric acid, a phosphate buffer, a sequestering agent and gum arabic. The pH of the etch soution is preferably in the range of about 4.0 to 5.0 at 25° C. We have found that etch solutions with pH higher than about 5.0 or lower than about 4.0 sometimes decrease the differences in hydrophilicity and oleophilicity between the toned and untoned areas of a plate surface. Consequently, the use of etch solutions having a pH outside the range of about 4.0 to about 5.0 may result in printing from the untoned areas of the plate.

Phosphoric acid etch solutions suitable for use in the method are commercially available. Examples of such etch solution include "Itek Premium Plate Etch" marketed by Philip A. Hunt Chemical Corporation, "ESKOFOT Offset-Etch" marketed by ESKOFOT Corporation, "Offset-Etch" marketed by A. B. Dick, and "HP Etching Solution PL-6" marketed by Iwatsu Electric Co. Ltd., located in Tokyo, Japan. Following the application of the etch solution, the plate may be dried in the manner used to dry the plate after the toning step. We have found that for the Pitman SR plate, the best results are obtained by heating the plate after applying the etch solution. The plate in such case is preferably heated to a temperature in the range of 110° C. to 150° C. for about 5–10 minutes. Equivalent results may be obtained at room temperature by waiting about 15 hours after application of the etch solution before printing. However, acceptable results are obtained even when the plate is used, without heating, immediately after applying the etch solution.

The lithographic printing plates produced by the method of the invention may be used to make more than about 50,000 impressions, preferably more than about 100,000 impressions. In such a printing process, preferably a conventional lithographic ink is repeatedly applied to the printing plate, thereafter transferred onto a rubber roller, and then to a substrate such as paper. Preferably, a fountain solution is applied to the printing plate before each printing cycle. Such fountain solutions are conventionaly used in lithographic printing processes to wet the untoned areas of the plate so that those areas repel the printing ink.

The example which follows illustrates the present invention.

EXAMPLE

We prepared a non-aqueous dispersion of a first amphipathic polymer and a dye in a solvent-carrier by (a) adding 360 grams of Isopar H (a branched aliphatic solvent marketed by the Exxon Corporation), 190 grams of vinylacetate, 30 grams of the precursor dispersion (30% by weight solids in Isopar H) described in Example V of the '760 patent, 21 grams of n-butylacidmaleate and 2.1 grams of AZBN, an initiator, to a 500 ml. resin reactor open to the atmosphere and equipped with a stirrer, a thermometer and a reflux condenser, (b) heating the resulting mixture to 65±2° C. and holding it at that temperature for 4 hours to initiate a poymerization reaction, (c) adding an additional 2 grams of AZBN to the mixture and maintaining the reaction mixture for another 4 hours at 65±2° C. to obtain a white latex, (d) adding to the white latex 13.65 grams of a dye and holding the temperature at 65±2° C. for 3 hours to obtain a latex having a dark color, and (e) filtering the latex through a 200 mesh nylon cloth and cooling the filtered latex to room temperature to obtain a dispersion containing 25% by weight of solids.

We prepared a concentrate of the liquid toner by combining 28 parts by weight of the dispersion described above, 30 parts by weight of a second dispersion which was prepared by repeating Example XVIII of the '760 patent and evaporating the solvent-carrier from the resulting product to a solids content of about 40% by weight, 1.1 parts by weight carbon black and 40.9 parts by weight Isopar H. The resulting mixture was milled in a pebble mill for 40 hours.

We completed preparation of a liquid toner for use in the field trial described below by combining 95 parts by weight of Isopar H, 5 parts by weight of the concentrate described above and 0.6 parts by weight of a negative charge director comprising the neutralized addition product of dodeoylbenzylchloride and polyethylene imine-18. The resulting liquid toner had a charge to mass ratio of $8\times10^{-3}$ C./g and a conductivity of 15 Nmhos/cm.

In the field trial, we applied to the anodized surface of a Pitman SR wipe-on anodized aluminum plate, an eleotrostatio charge corresponding to a half-tone image. The charge was applied by placing an imaged silk screen mask in close contact with the anodized surface of the plate and then charging the surface of the plate through the mask by corona discharge from a corona wire maintained at 9000 volts for 7 seconds.

We removed the mask from the selectively charged plate and toned the charged portions of the plate with the liquid toner described above by immersing the plate in the toner. The plate was then rinsed in Isopar H and dried in an oven at 110° C. to 150° C. for 10 minutes. We wiped the plate with ITEK Premium Plate Etch (pH 4.8) and then dried the plate in an oven at 110° C. to 150° C. for 5-10 minutes. ITEK etchant was again applied to the plate immediatey before installing the plate in a Hamada Star press.

A fountain solution comprising 3M Duplicator (pH 4.8), marketed by the Minnesota Mining & Manufacturing Co., diluted 1 part to 10 parts deionized water, and a standard lithographic ink (No. OK32750, supplied by Robert and Carlson, located in Newark, N.J.), were used in the press. The press was operated at a speed of 9100 impressions per hour to produce 45,000 prints on the first day. On the next day, 55,000 additional prints were made from the same plate. Overnight, between the two days, half of the plate was coated with a solution of gum arabic. This produced no difference in the quality of the prints obtained from the plate on the second day. The 100,000 prints produced had no background and no scumming. Also, the first 45,000 prints did not exhibit any visible shrinkage of the half-tone dots forming the image on the prints. After 45,000 prints, the dots did exhibit a slow rate of shrinkage which amounted to 15% after 100,000 prints.

We claim:

1. A method of making a lithographic printing plate comprising the steps of:

(a) selectively applying an electrostatic charge directly to the anodized surface of an anodized aluminum wipe-on printing plate in a predetermined pattern corresponding to the image to be printed;

(b) applying a liquid toner to the charged portions of the anodized surface; and (c) fixing the toner to the surface to provide a lithographic printing plate.

2. The method of claim 1 wherein the toner is fixed to the plate by drying the plate at an elevated temperature.

3. The method of claim 1 wherein the liquid toner has a charge to mass ratio in the range of about $8\times10^{-3}$ to about $134\times10^{-3}$ coulombs per gram and a conductivity of from about 13 to about 132 Nmhos/cm., and contains at least about 50% by weight film forming polymer based on the solids content of the liquid toner.

4. The method of claim 3 wherein the liquid toner contains at least about 90% by weight film forming polymer based on the solids content of the liquid toner.

5. The method of claim 3 wherein the film forming polymer is made from one or more of the following monomers: vinylacetate, the $C_1$ to $C_4$ alkyl esters of acrylic and methacrylic acids, styrene, methylstyrene, vinyltoluene and n-vinylpyrolidone.

6. The method of claim 3 wherein the film forming polymer is an amphipathic polymer.

7. The method of claim 1 further comprising the step of applying an etch solution comprising phosphoric acid to the surface of the printing plate after the toner is fixed to that surface.

8. The method of claim 7 wherein the etch solution comprises phosphoric acid, a phosphate buffer, a sequestering agent and gum arabic.

9. The method of claim 8 wherein the etch solution has a pH in the range from about 4.0 to about 5.0 at 25° C.

10. The method of claim 1 wherein the electrostatic charge is applied by a point corona discharge.

11. The method of claim 1 wherein the electrostatic charge is applied to the plate by covering its anodized surface with a silk screen mask having a pattern corresponding to the image to be printed and exposing the masked surface to a corona discharge.

12. The method of claim 3 wherein the liquid toner further comprises a charge director.

13. An anodized aluminum lithographic printing plate comprising an anodized aluminum wipe-on printing plate substrate having an anodized aluminum layer on one of the surface of said substrate and an oleophilic film on the surface of said anodized aluminum layer corresponding to the image to be printed, said film comprising a continuous layer of solids deposited by a liquid toner, said liquid toner having a solids content comprising at least 50% by weight of a film forming polymer.

14. The printing plate of claim 13 wherein the film forming polymer is made from one or more of the following monomers: vinylacetate, the $C_1$ to $C_4$ alkyl esters of acrylic and methacrylic acids, styrene, methylsytrene, vinyltoluene and n-vinylpyrolidone.

15. The printing plate of claim 13 wherein the film forming polymer is an amphipathic polymer.

16. A method of making a lithographic print comprising the steps of:

(a) selectively applying an electrostatic charge directly to the anodized surface of an anodized aluminum wipe-on printing plate in a predetermined pattern corresponding to the image to be printed;

(b) applying a liquid toner to the charged portions of the anodized surface;

(c) fixing the toner to the charged portions of the surface to provide a lithographic printing plate;

(d) applying printing ink to the imaged portions of the lithographic printing plate; and (e) transferring the printing ink from the lithographic printing plate to a substrate to obtain a lithographic print.

17. The method of claim 16 wherein steps (d) and (e) are repeated at least about 50,000 times.

18. The method of claim 17 wherein the liquid toner has a charge to mass ratio in the range of about $8\times10^{-3}$ to about $134\times10^{-3}$ coulombs per gram and a conductivity of from about 13 to about 132 Nmhos/cm, and contains at least about 50% by weight film forming polymer based on the solids content of the liquid toner.

19. The method of claim 16 wherein steps (d) and (e) are repeated at least about 100,000 times.

20. The method of claim 19 wherein the liquid toner has a charge to mass ratio in the range of about $8\times10^{-3}$ to about $134\times10^{-3}$ coulombs per gram and a conductivity of from about 13 to about 132 Nmhos/cm, and contains at least about 50% by weight film forming polymer based on the solids content of the liquid toner.

* * * * *